US007420123B2

(12) United States Patent
Klotz

(10) Patent No.: US 7,420,123 B2
(45) Date of Patent: Sep. 2, 2008

(54) CABLE

(75) Inventor: Dieter Klotz, Dorfen (DE)

(73) Assignee: Klotz Audio Interface Systems A.I.S. GmbH, Vaterstetten (DE)

( * ) Notice: Subject to any disclaimer, the term of this patent is extended or adjusted under 35 U.S.C. 154(b) by 0 days.

(21) Appl. No.: 11/638,686

(22) Filed: Dec. 13, 2006

(65) Prior Publication Data

US 2007/0137880 A1 Jun. 21, 2007

(30) Foreign Application Priority Data

Dec. 16, 2005 (DE) ..... 20 2005 019 690 U

(51) Int. Cl.
*H01B 7/00* (2006.01)

(52) U.S. Cl. ..... 174/120 R

(58) Field of Classification Search ..... 174/120 R, 174/120 SC
See application file for complete search history.

(56) References Cited

U.S. PATENT DOCUMENTS

| | | | | |
|---|---|---|---|---|
| 3,692,925 | A * | 9/1972 | Kindij | 174/120 C |
| 4,412,094 | A * | 10/1983 | Dougherty et al. | 174/110 F |
| 4,621,169 | A * | 11/1986 | Petinelli et al. | 166/241.3 |
| 6,696,647 | B2 * | 2/2004 | Ono et al. | 174/102 R |
| 2004/0055780 | A1 * | 3/2004 | Hakkarainen et al. | 174/120 R |
| 2005/0011664 | A1 * | 1/2005 | Lee | 174/102 SC |

* cited by examiner

*Primary Examiner*—Chau N Nguyen
(74) *Attorney, Agent, or Firm*—Carlson, Gaskey & Olds

(57) ABSTRACT

A cable, in particular an audio cable, has an inner conductor surrounded by a dielectric and a conductive layer surrounding the dielectric. A separating layer is inserted between the dielectric and the conductive layer.

7 Claims, 1 Drawing Sheet

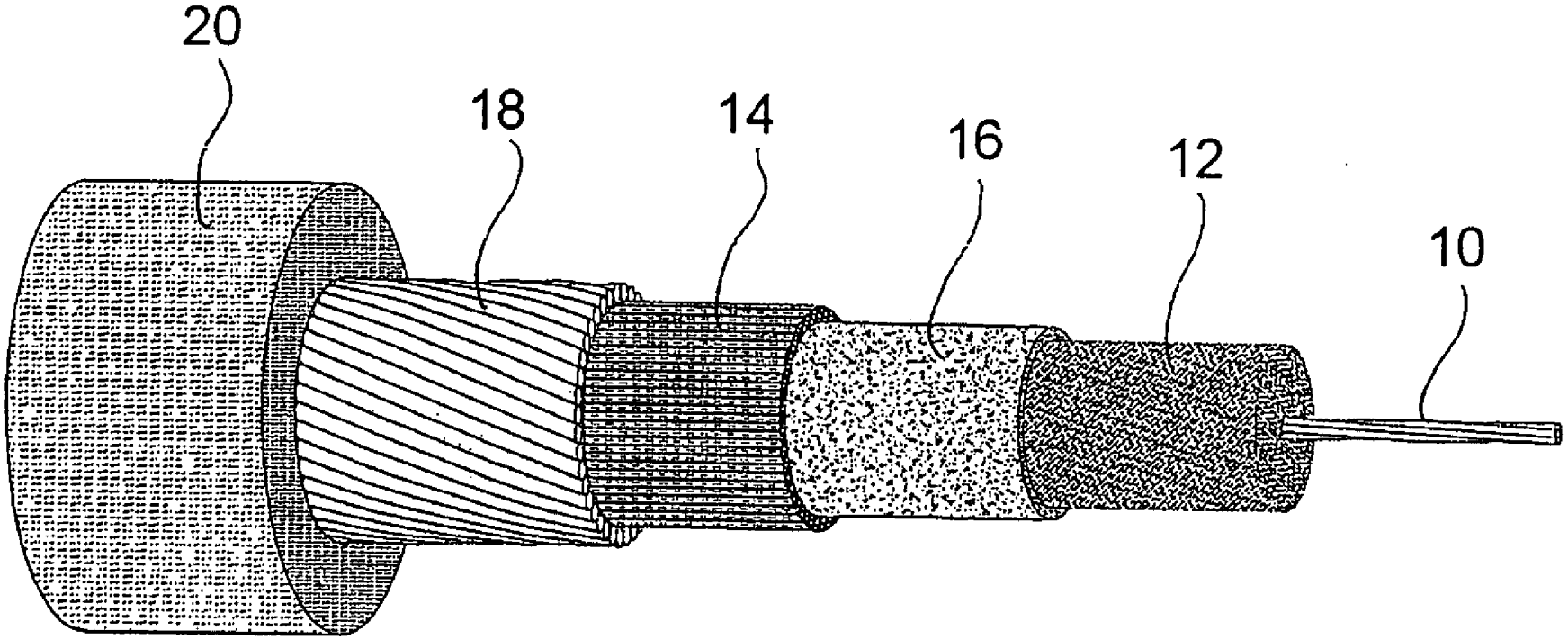
20
18
14
16
12
10

CABLE

RELATED APPLICATIONS

The application claims priority to German Application No. 20 2005 019 690.8, which was filed on Dec. 16, 2005.

TECHNICAL FIELD

The invention relates to a cable, in particular to an audio cable, comprising an inner conductor surrounded by a dielectric and a conductive layer surrounding the dielectric.

BACKGROUND OF THE INVENTION

Instrument cables (as well as measuring leads and the like) are usually non-symmetrical lines having a coaxial structure. Viewed from the outside to the inside, a typical instrument cable includes an outer jacket made of polyvinyl chloride (PVC), a copper helical shield or a copper braiding, a conductive plastic layer made of conductive PVC or polyethylene (PE), a dielectric (conductor insulation) made of solid or foamed polyolefins (PE or PP), and a copper inner conductor. For the electric quality of such a cable, the values for the conductor resistance and the capacitance (conductor/shield) are relevant. Due to the use as a connecting line between high-impedance devices (inductive sensors and high-impedance amplifiers), a microphonic effect or "microphony" occurs as an interfering component. This term is understood to mean noises which are audible in the form of crackling and sizzling upon movement of the cable. Microphony may likewise be indicated in values, with a higher value representing a poorer interference performance and a lower value representing a better interference performance.

In order to curb microphony, in the conventional production process a conductive layer serving as a shield is applied inside the cable over the dielectric directly surrounding the inner conductor, as is shown in EP 0 260 373 A2, for example. The conductivity of this shield has a decisive influence on microphony: the higher the conductivity, the lower the microphonic effect. The conductive layer is usually formed of electrically conductive PE or PVC. PE has a conductivity that is 100 times higher than that of PVC, so that under this aspect PE is basically preferable to PVC.

What presents a problem, however, is the bonding of the conductive layer to the dielectric surrounding the inner conductor. When a dielectric without foaming is used, for example, further processing is necessary to separate the conductive layer from the dielectric, such separation generally leads to the dielectric being torn off. In the case of a foamed dielectric, as known from U.S. Pat. No. 5,523,528, for example, it is impossible to separate the conductive layer from the dielectric. Only the use of a separating agent (e.g. graphite) that is applied between the two components, such as proposed in U.S. Pat. No. 4,678,865, can provide a remedy in this case. But, on the other hand, separating agents generally have the disadvantage that they considerably contribute to a deterioration of the microphony behaviour of a cable.

In conventional cable manufacturing, attempts have therefore been made to counter this problem by using a conductive layer made of PVC, which however does not bond to the dielectric made of polyolefins. The poorer conductivity resulting therefrom leads to an increase in microphony.

It is therefore an object of the present invention to provide a cable having an improved microphony performance while eliminating the drawbacks described above.

SUMMARY OF THE INVENTION

According to the invention, a cable comprises an inner conductor surrounded by a dielectric and a conductive layer surrounding the dielectric. The cable further comprises a separating layer which is inserted between the dielectric and the conductive layer. It has turned out that with this novel cable design, a processing and microphony performance can be achieved that is not attainable with conventionally structured cables. For this reason, a more complex manufacture, which is required due to insertion of an additional layer, is acceptable.

According to the preferred embodiment of the invention, the separating layer is electrically non-conductive. PVC is a particularly suitable material for the separating layer.

The dielectric is preferably made of solid or foamed polyolefins, in particular PE or PP. Such a conductor insulation provides for good capacitances.

The preferred embodiment further provides for a conductive layer made of electrically conductive PE. Such a PE layer has a relatively high conductivity, i.e. compared with a layer made of conductive PVC, the electrical resistance of a layer made of conductive PE is distinctly lower.

These and other features of the present invention can be best understood from the following specification and drawings, the following of which is a brief description.

BRIEF DESCRIPTION OF THE DRAWINGS

The single drawing FIGURE shows a perspective side view of a cable according to the invention, with the layers having been removed section by section.

DETAILED DESCRIPTION OF THE PREFERRED EMBODIMENT

The cable illustrated in the FIGURE is an audio cable having a coaxial structure. A copper strand is used as an inner conductor 10. The inner conductor 10 is surrounded by a dielectric 12 made of cellular PP, which serves to insulate the inner conductor 10. The dielectric 12, in turn is surrounded by a conductive layer 14 made of PE having a very high conductivity.

An additional layer 16 is inserted between the dielectric 12 and the conductive layer 14. This layer 16 serves mechanically as a separating layer and electrically as a dielectric, i.e. it is electrically non-conductive. In the preferred embodiment as illustrated, the separating layer 16 is made of PVC.

The cable further includes a helical copper shield 18 surrounding the conductive layer 14, and an outer jacket 20 made of PVC.

Compared with conventional audio cables, a cable having this structure exhibits a considerably improved microphonic performance, with a separation of the dielectric 12 from the conductive layer 14 being provided for, which allows a stripping of the cable without problems.

The invention is, however, not limited to the example of an audio cable. The structure according to the invention is also suitable for cables in other fields of application in which microphonic or similar effects are to be eliminated.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. An audio cable comprising:

an inner conductor;

a dielectric directly surrounding the inner conductor;

a conductive layer surrounding the dielectric, the conductive layer being made of electrically conductive polyethylene;

one of a helical shield and a braided shield directly surrounding the conductive layer;

an outer jacket directly surrounding the one of the helical shield and the braided shield;

a separating layer inserted between the dielectric and the conductive layer, wherein the separating layer directly surrounds the dielectric, is directly surrounded by the conductive layer, and is made of polyvinyl chloride, and wherein the separating layer and the dielectric are movable relative to each other; and wherein the inner conductor, the dielectric, the conductive layer, the one of the helical shield and the braided shield, the outer jacket, and the separating layer cooperate to form an audio cable that transmits audio signals.

2. The audio cable according to claim 1, wherein the separating layer is electrically non-conductive.

3. The audio cable according to claim 1, wherein the dielectric is made of one of solid polyolefins and foamed polyolefins.

4. The audio cable according to claim 1, wherein the audio cable only includes layers comprising the inner conductor, the dielectric, the conductive layer, the one of the helical shield and the braided shield, and the separating layer.

5. The audio cable according to claim 1 wherein the separating layer is separate from the dielectric.

6. The audio cable according to claim 1 wherein the separating layer and the conductive layer are movable relative to each other.

7. An audio cable comprising:

an inner conductor;

a dielectric directly surrounding the inner conductor;

a conductive layer surrounding the dielectric, the conductive layer being made of electrically conductive polyethylene;

one of a helical shield and a braided shield directly surrounding the conductive layer;

an outer jacket directly surrounding the one of the helical shield and the braided shield;

a separating layer inserted between the dielectric and the conductive layer, wherein the separating layer directly surrounds the dielectric, is directly surrounded by the conductive layer, and is made of polyvinyl chloride;

wherein the inner conductor, the dielectric, the conductive layer, the one of the helical shield and the braided shield, the outer jacket, and the separating layer cooperate to form an audio cable that transmits audio signals; and wherein the separating layer and the dielectric layer are non-bonded, discrete layers that are movable relative to each other in an axial direction defined as extending along a length of the audio cable.

* * * * *